US005335381A

United States Patent [19]

Chang

[11] Patent Number: 5,335,381

[45] Date of Patent: Aug. 9, 1994

[54] BED HAVING A WARMING DEVICE

[76] Inventor: Chung-Tai Chang, P.O. Box 1032, Tainan, Taiwan

[21] Appl. No.: 150,824

[22] Filed: Nov. 12, 1993

[51] Int. Cl.[5] ..... A47C 27/08; A47C 27/00

[52] U.S. Cl. ..... 5/423; 5/449; 5/450; 297/180.14

[58] Field of Search ..... 5/423, 284, 469, 449, 5/450, 475, 421; 297/180.14; 62/261; 128/376

[56] References Cited

U.S. PATENT DOCUMENTS

| | | | |
|---|---|---|---|
| 2,493,067 | 1/1950 | Goldsmith | 5/469 |
| 2,606,996 | 8/1952 | Westerberg et al. | 5/423 |
| 3,266,064 | 8/1966 | Figman | 5/423 |
| 4,141,585 | 2/1979 | Blackman | 297/180.14 |

FOREIGN PATENT DOCUMENTS

| | | | |
|---|---|---|---|
| 1910954 | 9/1970 | Fed. Rep. of Germany | 5/423 |
| 119909 | 10/1989 | Taiwan . | |
| 1574888 | 9/1980 | United Kingdom | 5/469 |

*Primary Examiner*—Alexander Grosz

[57] ABSTRACT

A bed with a cushion having an enclosed space formed in the inner portion, a heating element disposed in the enclosed space for generating warm air and a fan for circulating the warm air within the enclosed space in order to warm up the cushion. The cushion may either be an air cushion or a spring cushion. The cushion includes an air passage formed in the space, with the heating device disposed in the air passage for circulating the warm air in the air passage. The heating element may be a positive-temperature-coefficient thermistor heating element.

5 Claims, 5 Drawing Sheets

BED HAVING A WARMING DEVICE

BACKGROUND OF THE INVENTION

1. Field of the Invention

The present invention relates to a bed, and more particularly to a bed having a warming device.

2. Description of the Prior Art

Typically, in order to warm up the bedroom, an electrical heater or the like is used for heating the air in the room; however, the warm air rises to the upper part of the room so that the lower part of the room will not be warmed until the whole room is filled with heated air. This wastes energy.

In order to save energy, one kind of warming device developed for warming a bed is disclosed in Taiwan Application Ser. No. 76211177 to Yang, filed on Nov. 20, 1987, published on Oct. 1, 1989 with publication No. 119909. The bed includes a cushion having an air-permeable upper surface and separated into a plurality of chambers. A tube is disposed in the bed and communicates with a motor which generates warm air and supplies the warm air into the tube for warming the cushion. The warm air may permeate through the upper surface of the cushion; however, a motor with large power is required for pumping up the cushion. In addition, the portion of the bed close to the tube may have a higher temperature than other portions of the bed; furthermore, the motor is disposed outside the cushion and may spoil the appearance of the cushion.

The present invention has arisen to mitigate and/or obviate the afore-described disadvantages of the conventional beds.

SUMMARY OF THE INVENTION

The primary objective of the present invention is to provide a bed having a warming device for uniformly warming up the bed.

In accordance with one aspect of the invention, there is provided a bed comprising a cushion including an enclosed space formed therein, with a heating device disposed in the enclosed space of the bed. A heating element generates warm air and a fan circulates the warm air within the enclosed space in order to warm up the cushion.

The cushion may either be an air cushion or a spring cushion. The cushion includes an air passage formed in its interior, with the heating device disposed in the air passage for circulating the warm air in the air passage. The heating element may be a positive-temperature-coefficient thermistor heating element.

Further objectives and advantages of the present invention will become apparent from a careful reading of the detailed description provided hereinabove, with appropriate reference to the accompanying drawings.

DETAILED DESCRIPTION OF THE PREFERRED EMBODIMENT

Figure 1:
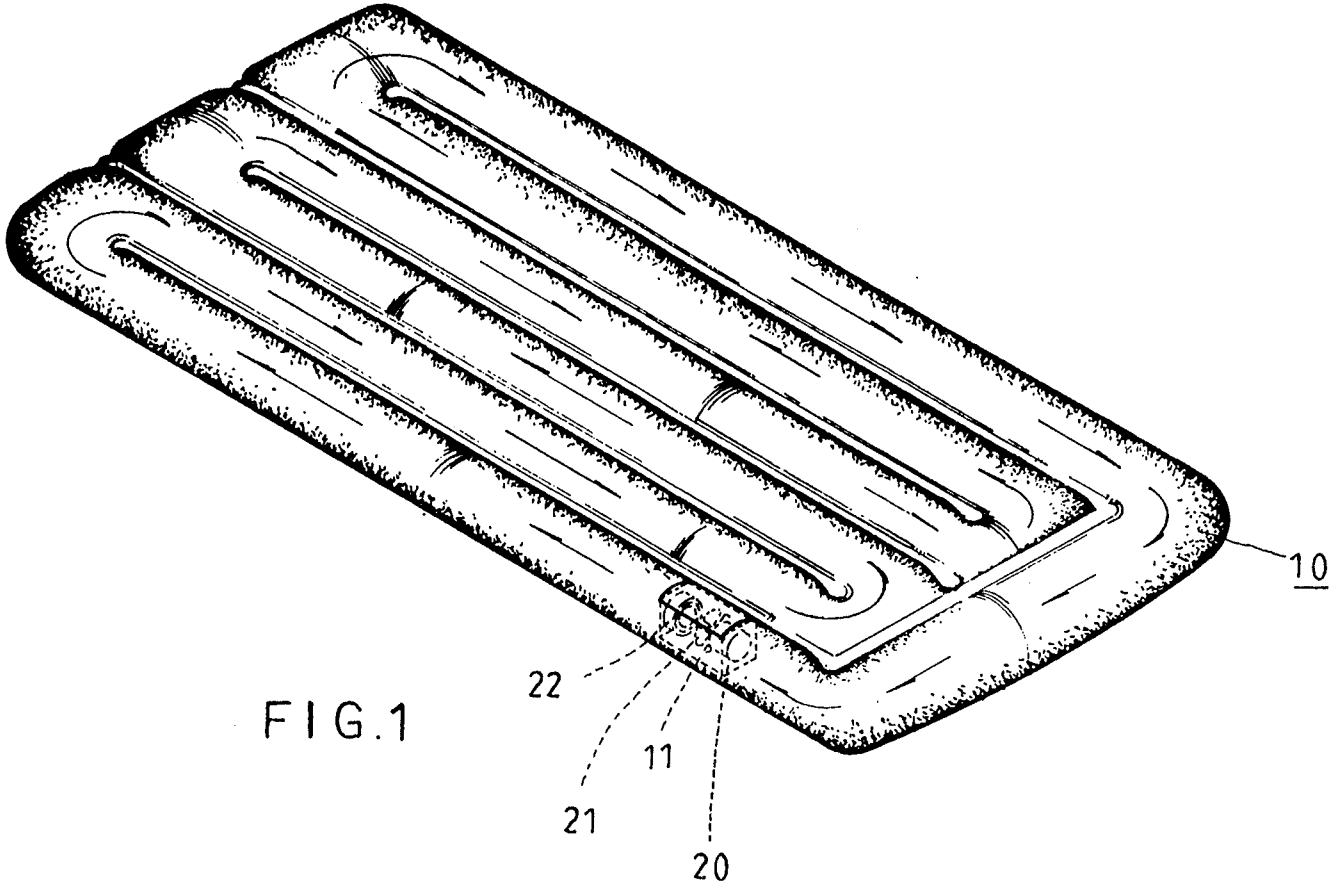
FIG. 1. is a perspective view of a bed in accordance with the present invention.
Figure 2:
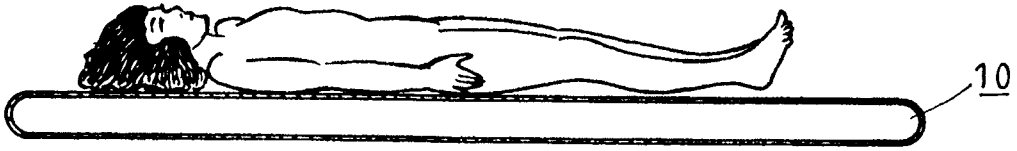
FIG. 2 is a cross sectional view of the bed, illustrating the application of the bed.

Referring to the drawings, and initially to FIGS. 1 and 2, a bed in accordance with the present invention comprises an air cushion 10 which has an enclosed and endless air passage formed therein. The cushion 10 is filled with air, and a heating device 20 is disposed in the air passage at the position indicated by the reference numeral 11. The heating device 20 includes a fan 21 and a heating element 22. The heating element 22 may be a heating coil or a so-called positive-temperature-coefficient (PTC) thermistor heating element. The fan 21 is provided for circulating the air warmed up by the heating element 22 in the air passage. The current of the PTC heating element will be decreased when the temperature increases up to a so-called Curie-Temperature so that the PTC heating element will not be heated further. However, when the temperature is lowered below the Curie-Temperature, the resistance of the PTC heating element is decreased and the current is increased, whereby, the PTC heating element is heated again. It is to be noted that the Curie-Temperature is lower than the burning point of the toilet paper such that the PTC heating element is a safe heating device.

In operation, the warm air generated by the heating element 22 will be circulated within the air passage by the fan 21 such that the air cushion will be warmed up by the warm air so that the user can be warmed up by the air cushion. The warm air will not flow out of the air cushion so that energy can be saved.

Figure 3:
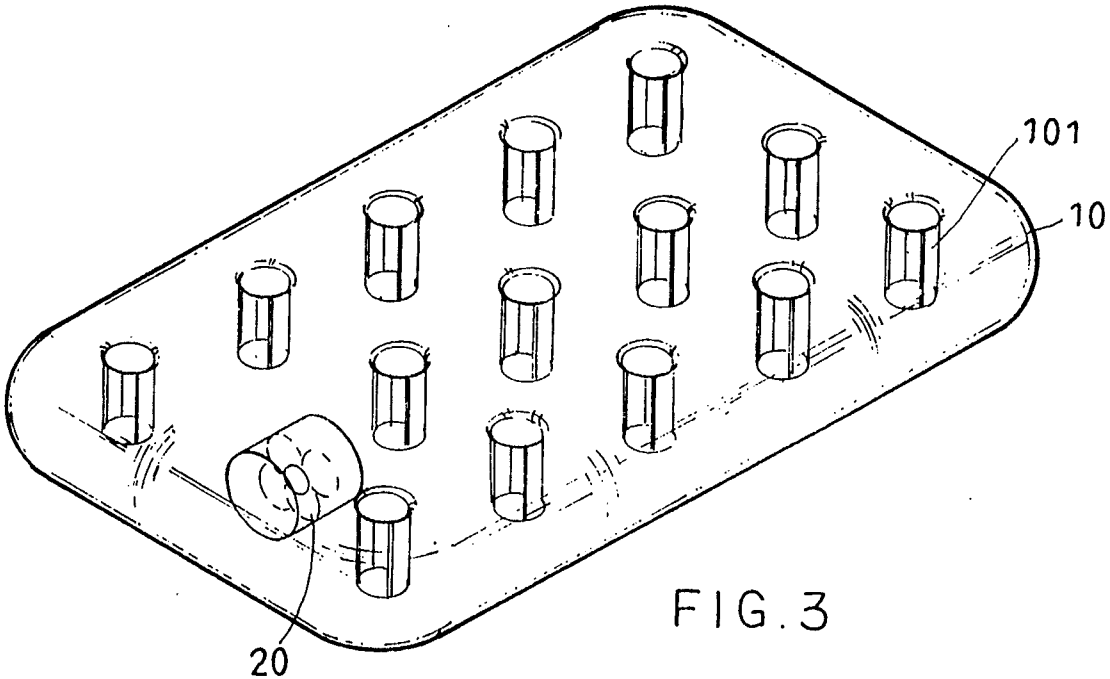
FIG. 3 is a perspective view of another embodiment of the bed.
Figure 4:
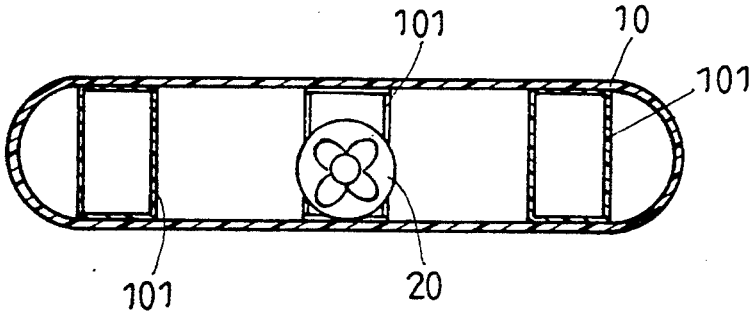
FIG. 4 is a cross sectional view of the bed as shown in FIG. 3.

Referring next to FIGS. 3 and 4, the air cushion 10 can be formed with an enclosed and single hollow space having a plurality of coupling members 101 for coupling the upper surface and the lower surface of the air cushion. The warm air generated by the heating device 20 may be circulated within the hollow space of the air cushion by the fan.

Figure 6:
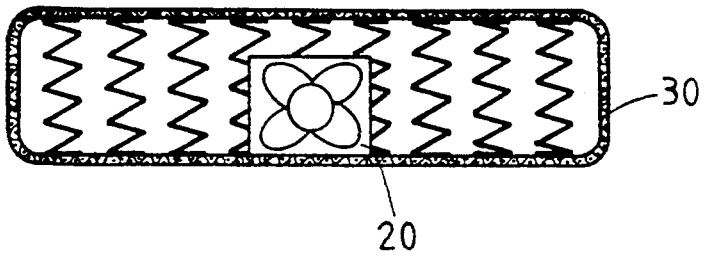
FIG. 6 is a cross sectional view of the bed as shown in FIG. 5.
Figure 5:
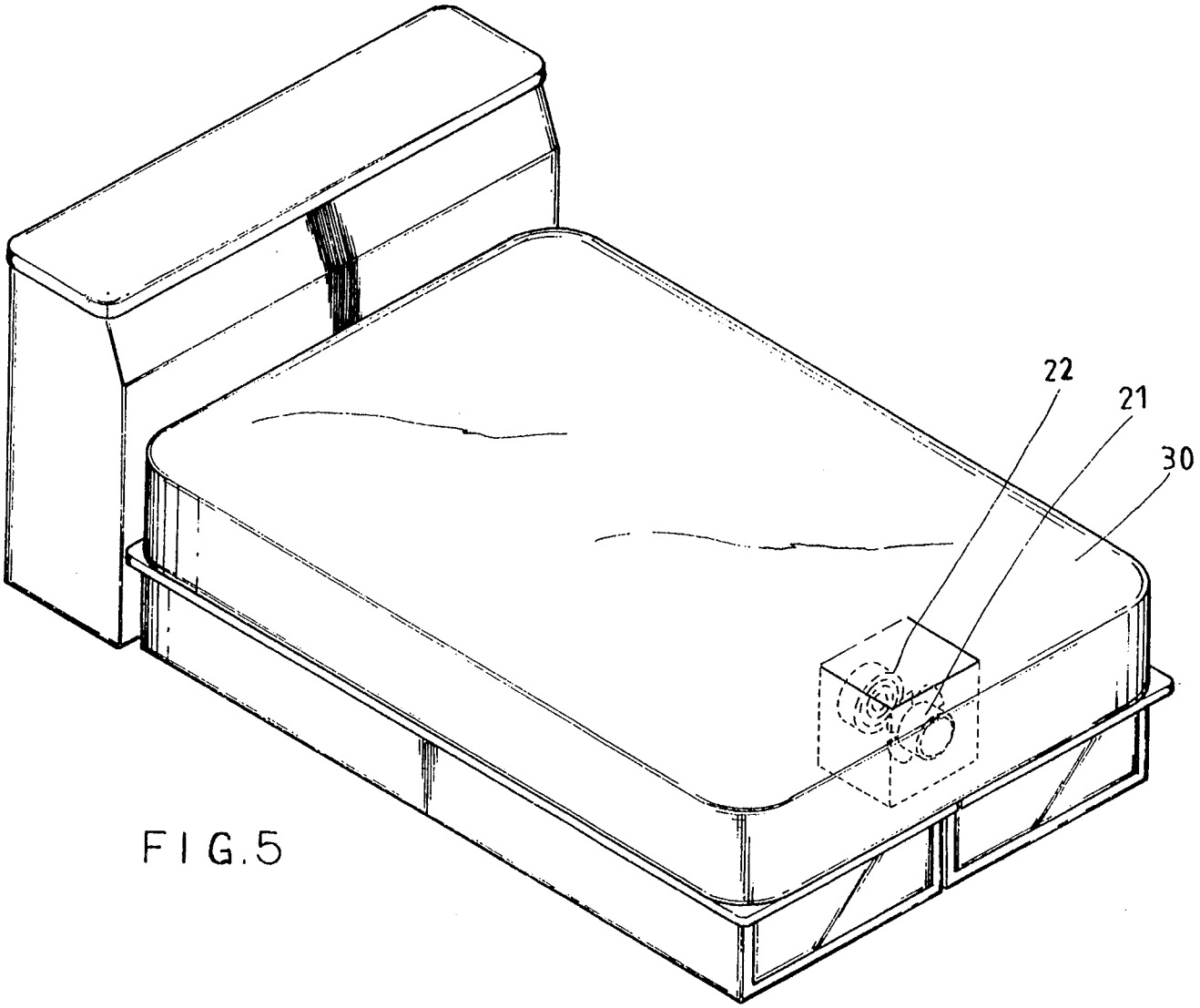
FIG. 5 is a perspective view of still another embodiment of the bed.

Referring next to FIGS. 5 and 6, the heating device 20 may also be disposed in a spring cushion 30. The warm air generated by the heating element 22 may also be circulated by the fan 21 in order to warm up the spring cushion.

Accordingly, the bed in accordance with the present invention includes a heating device which is disposed within the cushion so as to not spoil the outer appearance of the cushion. In addition, the warm air will not flow out of the cushion so that energy is saved. Furthermore, the cushion can be uniformly warmed.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A bed comprising:

a cushion including an enclosed, airtight space formed therein, said space containing air, a heating device disposed in said enclosed space of said bed, said heating device including a heating element adapted to warm the air within said space, and a fan for circulating said warm air within said enclosed space, in order to warm said cushion.

2. The bed according to claim 1 wherein:

said cushion comprises springs.

3. The bed according to claim 1 wherein:

said enclosed, airtight space is compartmented to define an endless-looplike passage.

4. The bed according to claim 1 wherein:

said enclosed, airtight space comprises upper and lower surfaces and coupling members coupling said upper and lower surfaces.

5. The bed according to claim 1 wherein:

said heating element is a positive-temperature-coefficient thermistor heating element.

* * * * *